US011768057B2

(12) United States Patent
McRee

(10) Patent No.: US 11,768,057 B2
(45) **Date of Patent: *Sep. 26, 2023**

(54) EMBEDDED CANT INDICATOR FOR RIFLES

(71) Applicant: McRee's Multi Services, LLC, McCarley, MS (US)

(72) Inventor: Scott McRee, McCarley, MS (US)

(73) Assignee: McRee's Multi Services, LLC, McCarley, MS (US)

( * ) Notice: Subject to any disclaimer, the term of this patent is extended or adjusted under 35 U.S.C. 154(b) by 28 days.

This patent is subject to a terminal disclaimer.

(21) Appl. No.: 17/405,059

(22) Filed: Aug. 18, 2021

(65) Prior Publication Data

US 2022/0113118 A1 Apr. 14, 2022

Related U.S. Application Data

(60) Continuation of application No. 16/207,069, filed on Nov. 30, 2018, now Pat. No. 11,105,588, which is a continuation-in-part of application No. 15/680,822, filed on Aug. 18, 2017, now abandoned, which is a division of application No. 15/061,613, filed on Mar. 4, 2016, now Pat. No. 9,777,992, which is a division (Continued)

(51) Int. Cl.

| | |
|---|---|
| ***F41G 1/44*** | (2006.01) |
| ***F41C 27/22*** | (2006.01) |
| *F41C 23/22* | (2006.01) |

(52) U.S. Cl.

CPC ..... *F41G 1/44* (2013.01); *F41C 27/22* (2013.01); *F41C 23/22* (2013.01)

(58) Field of Classification Search

CPC ..... F41C 27/00; F41C 27/22; F41C 23/14; F41G 1/44; F41G 3/10; F41A 35/00

USPC ..... 42/90, 124, 125, 113, 123; 33/373, 298; 89/37.13, 41.19

See application file for complete search history.

(56) References Cited

U.S. PATENT DOCUMENTS

| | | | |
|---|---|---|---|
| 168,941 A | 10/1875 | Treadway | |
| 175,702 A | 4/1876 | Haskell | |

(Continued)

FOREIGN PATENT DOCUMENTS

| | | | | |
|---|---|---|---|---|
| CH | 114510 | | 1/1925 | |
| GB | 2332039 | | 1/1999 | |
| GB | 2332039 A | * | 6/1999 | ..... F41C 23/14 |

OTHER PUBLICATIONS http://www.calguns.net/calgunforum/showthread.php?t=270390 (Feb. 17, 2010, post #22, p. 16).

(Continued)

*Primary Examiner* — John Cooper

(57) ABSTRACT

A device comprised of bubble level inserted into and secured within a cavity located above the rifle grip and behind the barrel to facilitate the measurement and compensation of the rifle's cant while lining up the rifle's sights. The device is precision machined to allow the bubble to be aligned with the axis of the barrel to produce a true "zero-cant" condition. Graduation markings are placed on either left or right of the bubble level to allow the user to better judge the relative degree of cant. A light source is placed adjacent to the bubble level to illuminate cant for a shooter in a dark environment. Methods of using the embedded cant indicator for precision shooting are presented.

20 Claims, 6 Drawing Sheets

Related U.S. Application Data of application No. 14/842,925, filed on Sep. 2, 2015, now Pat. No. 9,593,909, which is a division of application No. 14/154,214, filed on Jan. 14, 2014, now Pat. No. 9,170,067.

(56) References Cited

U.S. PATENT DOCUMENTS 1,679,221 A * 7/1928 Kelm ..... F41G 1/44 89/200
1,940,808 A * 12/1933 Linsert ..... F41G 1/48 33/372
2,243,793 A * 5/1941 Cummins ..... F41G 1/38 42/122
5,005,308 A * 4/1991 Parks ..... F41G 1/38 33/366.21
5,223,650 A * 6/1993 Finn ..... F41G 1/38 42/122
5,315,781 A * 5/1994 Beisner ..... F41G 1/44 42/1.01
5,406,733 A * 4/1995 Tarlton ..... F41G 1/44 42/111
5,657,571 A * 8/1997 Peterson ..... F41G 1/44 42/122
5,878,504 A 3/1999 Harms
6,813,855 B2 11/2004 Pinkley
6,877,266 B1 * 4/2005 Brownlee ..... F41A 23/16 89/37.04
6,978,569 B2 * 12/2005 Williamson, IV ..... F41G 1/44 42/144
7,257,920 B1 * 8/2007 Shaffer ..... F41G 1/30 42/118
7,905,044 B2 3/2011 Clouser
8,316,571 B1 * 11/2012 Holland ..... F41A 23/16 42/108
8,695,266 B2 4/2014 Moore
8,819,985 B1 * 9/2014 McCoy ..... F41G 11/001 42/111
9,015,982 B1 * 4/2015 Powers ..... F41G 11/003 42/124
9,170,067 B2 * 10/2015 McRee ..... F41G 1/44
9,239,208 B2 * 1/2016 Miller ..... F41C 23/16
9,316,571 B2 4/2016 Muller
2003/0177685 A1 * 9/2003 Pinkley ..... F41G 1/54 42/135
2004/0148841 A1 * 8/2004 Burzel ..... F41G 1/44 42/123
2005/0252064 A1 * 11/2005 Williamson, IV ..... F41G 1/44 42/123
2007/0113460 A1 * 5/2007 Potterfield ..... F41G 1/44 42/120
2007/0144051 A1 * 6/2007 Moore ..... F41G 1/54 42/116
2008/0134561 A1 * 6/2008 Clouser ..... F41G 1/42 42/127
2011/0271535 A1 * 11/2011 Varner ..... F41G 1/467 33/265
2014/0090259 A1 * 4/2014 Stockdill ..... F41G 1/44 33/298

OTHER PUBLICATIONS http://www.caprc.com/forum/viewtopic.php?t=2682 &sid13fcdd7d8 (Jan. 24, 2011, p. 3 and 7).

* cited by examiner

EMBEDDED CANT INDICATOR FOR RIFLES

CROSS-REFERENCES

This is a Continuation of U.S. patent application Ser. No. 16/207,069 filed Nov. 30, 2018, which in turn claims the benefit of U.S. patent application Ser. No. 15/680,822 filed on Aug. 18, 2017, which in turn claims the benefit of U.S. patent application Ser. No. 15/061,613 filed on Mar. 4, 2016, which in turn claims the benefit of Ser. No. 14/842,925 filed on Sep. 2, 2015, which in turn claims the benefit of Ser. No. 14/154,214 filed on Jan. 14, 2014, the entireties of which are hereby claimed as priority and incorporated by reference.

FIELD OF THE INVENTION

This invention relates generally to rifle style firearms, and particularly concerns both apparatus and methods for readily and precisely determining the cant of the rifle relative to the target such that the shooter can make appropriate aim adjustments to improve the probability of hitting the target. The location of the cant measurement device is designed to facilitate the shooters assessment of the rifle's cant when viewing other sighting mechanisms on the rifle.

BACKGROUND OF THE INVENTION

Accuracy in placing a projectile onto a target using a rifle requires the shooter to determine three primary elements: 1) distance to the target, 2) the incline of the rifle as the projectile leaves the rifle, and 3) the cant of the rifle at the moment the projectile leaves the rifle. A rifle's cant is defined as the degree of rotational tilt the rifle has along the axis of the barrel. Determining distance and incline are part of "sighting" a rifle to a target and generally require several elements that must be determined by the shooter. Since gravity tends to bring the projectile downward, the barrel must often be inclined to hit a target at some distance. Commonly used sights for setting the incline can be a groove or aperture at the rear end of the post or the point at the barrel end-muzzle. Once the shooter determines a point at which the projectile is aimed, the shooter aligns the post into the groove, which effectively aligns the rifle both horizontally and vertically to the point of aim.

However, such sighting mechanisms may not offer the shooter with the degree of accuracy that may be desired. To improve the accuracy of the horizontal and vertical alignment, some rifle assemblies make use of a scope. A scope typically provides the shooter with a glass view port displaying horizontal and vertical lines in addition to a magnified view of the point of aim. Scopes incorporate vertical and horizontal adjustment mechanisms. The shooter makes the calculated vertical and horizontal adjustments to account for situational issues such as wind, temperature, and distance and aligns the point of aim with the intersection of these two lines, commonly referred to as cross-hairs. Scopes can contain a system of lines, dots, cross hairs, wires, or electrically projected images which aid aligning the barrel to the point of aim. Scopes are generally mounted on top of the action assembly near the back end of the barrel of the rifle and are attached thereto with a mechanism for adjustment. A common adjustment mechanism is a ring and slotted bar-rail device also known as scope ring and base. These adjustments are typically made at a shooting range or target practice area where the rifle is placed in a holder to ensure proper alignment and target distances are accurately known.

Using this method, a rifle and scope can be adjusted to provide the shooter with a high degree of accuracy.

However, using a holder at a shooting range for calibrating a rifle's proper incline as a function of distance to the target often does not represent real world situations where the shooter is either standing or prone with the rifle being held at the time of firing. In these situations, the rifle is often twisted or rotated about the axis of the barrel. The physics of projectile firing is greatly affected by this degree of rotation or "cant" of the rifle at the moment of firing. For example, a left angle of cant tends to result in the projectile impacting the target to the lower left of the point of aim. Shooters, especially competition target shooters, must compensate for the cant of the rifle to improve shot accuracy.

Various mechanisms have been presented in the prior art to provide feedback to the shooter about the degree of cant during their aim. One such example is U.S. Pat. No. 6,813,855 where Pinkley presents an apparatus where among other accompanying pieces, a bubble level is strapped to the rifle stock underneath the scope. Pinkley's cant compensation method involves the steps of positioning the firearm and scope with a canted reticle system so that its vertical axis is positioned as indicated by the level bubble of the mounted level sub-assembly, positioning the vertical reference shaft sub-assembly a distance from the muzzle end of the firearm. The shooter then rotates the scope on the firearm sufficiently to align the vertical cross hair of the scope reticle system with the distant vertical reference shaft sub-assembly. Lastly, the shooter locks the sighting scope in the corrected position on the firearm.

The prior art attempts to provide the shooter with feedback for the cant of the rifle tend to be attached to the scope and, as such, are accessories that must be carefully attached to the scope and are not suitable for shooting situations where speed and durability are required. Also, the prior art cant measurement systems themselves must be thoroughly tested and calibrated by the shooter so that typically only that shooter, with that cant feedback device, on that special rifle, which is carefully calibrated by a trained technician can be used to produce the degree of accuracy required in critical or competitive shooting environments.

It has been discovered that by locating a pre-calibrated bubble level between the shooter's eye and the scope and carefully machining the bubble level within the rifle stock system, a reliable cant feedback system can be readily made available to any shooter and repeatable across an entire weapon platform. Also, by carefully embedding the bubble level within the body of the rifle, the cant feedback method can be durable and repeatable for a whole range of shooting applications, especially for the war-fighter.

Additionally, by embedding the cant level indicator into the rifle's stock and providing an accurate measurement of the rifle's cant, calibrating the firearm is greatly facilitated. By placing a plumb line at the desired target calibration distance (100 yards or 100 meters, for example), and then aligning the vertical reticle of the scope with the rifle at zero cant, the scope reticle-aiming reference is "trued" to the cant axis of the rifle. Once this initial process is completed, the rifle and scope are now calibrated for a "zero-cant" condition relative to each other.

SUMMARY OF THE INVENTION

The present invention presents an embedded precision level indicator that provides a true reference to level or plumb allowing for the final cant correction to be made before the shot is taken. The present invention provides the rifle shooter with a tool that greatly enhances "first-round-hit" probabilities and increases overall accuracy. The invention is located so that the rifle shooter does not have to change or disturb his body position to monitor the cant of the rifle.

The invention is machined into the rifle stock and is aligned with the horizontal axis of the center line. This horizontal axis is perpendicular to the vertical center line referenced from top to bottom. This horizontal axis can also be described as the 3 o'clock to 9 o'clock "cant axis". This invention provides the rifle shooter with one more calculation used in making the perfect shot at even longer distances from the target. This feedback is of critical importance because cant measuring mechanisms of the prior art did not solve the issue of "man-introduced-errors" because the mounting of the cant level indicator is often not performed by a specially trained technician. These specially-trained technicians often install several items for reference points but none of them are truly calibrated to the horizontal plane.

The invention presented herein is machined into the assembly on the same plane as the cant axis. The accuracy of locating the invention true to the cant axis is enhanced by the use of computer-aided tools with very small error tolerances. A set of cant reference gradients is machined into the assembly as well. The reference gradients allow for duplicating the cant if a "Zero Cant" condition is not achievable. The shooter can perform a quick calculation that formulates the amount of "Point of Aim" adjustment required to successfully engage the target due to the amount of Cant introduced into the rifle. This combination of location, precision machining and calibration feedback allows shooters with limited experience and in situations of duress to greatly improve shot accuracy.

The invention herein presents methods of using the embedded cant indicator to provide a shooter with an optimized and compensated alignment system that maximizes the accuracy and repeatability of hitting the shooter's target and provides a weapon system that achieves this high level of precision compensation between the target and weapon in a most convenient manner.

DETAILED DESCRIPTION OF THE PREFERRED EMBODIMENT(S)

Figure 1:
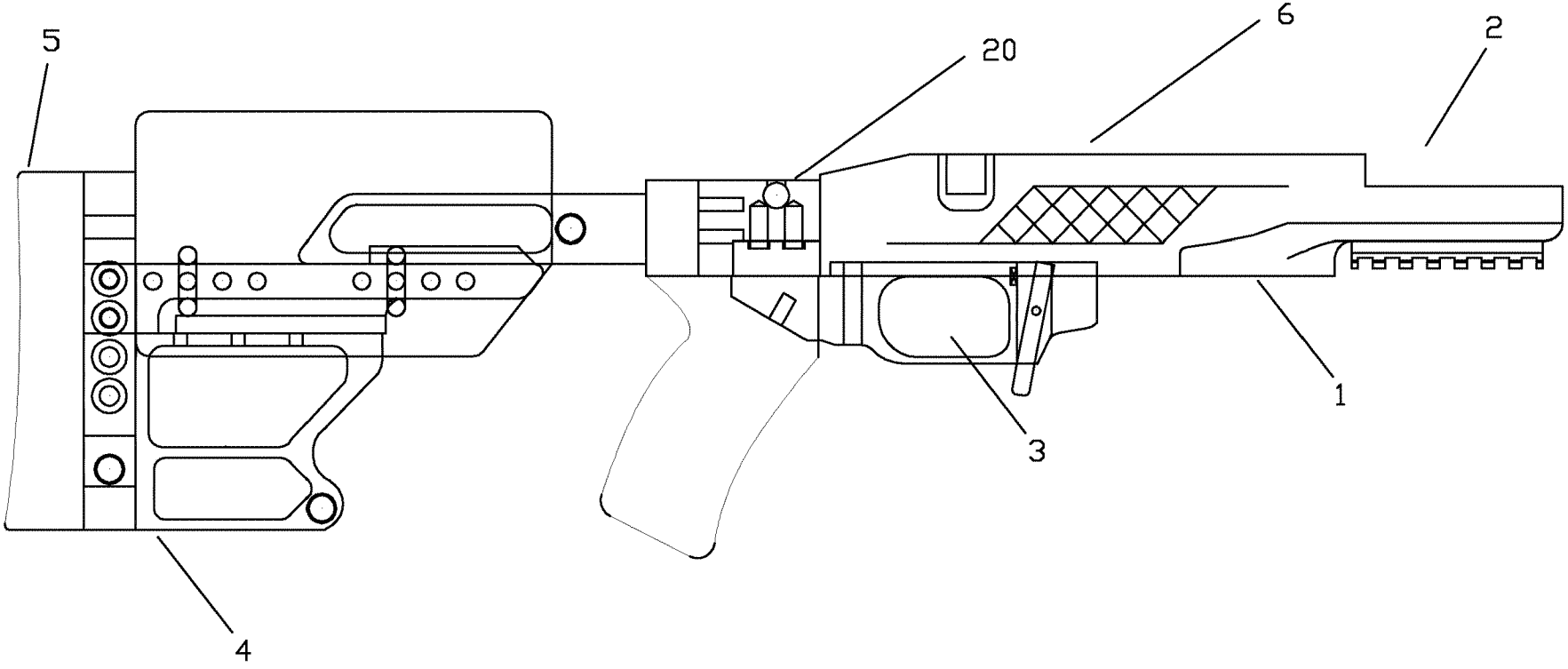
FIG. 1 is a perspective view of the invention apparatus located in its position relative to the stock of the rifle and overall weapon platform. The barrel of the rifle and the sighting mechanisms are not shown but would be understood to one skilled in the art where these components are located on this rifle stock assembly.

FIG. 1 illustrates one embodiment of the invention as an element of an overall weapon assembly. This weapon assembly is comprised of multiple parts that are bolted together to provide a functioning rifle. In its most basic form, this particular weapon platform is comprised of a stock 1, a cant indicator 20, the butt of the rifle stock 4, a recoil absorbing pad 5. The barrel of the rifle attaches at point 2. If the shooter desires a scope, it can be attached to the stock at 6. As the shooter holds the weapon and views a target through the scope in a direction parallel to the axis of the rifle barrel, the cant indication can be obtained by glancing downward at a bubble contained within the cant indicator assembly 20. By using the calibration lines, as will be further described in later Figures, the position of the bubble to the left or right of the center line will indicate the extent to which the rifle is tilted about the axis of the barrel. A shooter can either rotate the weapon to eliminate the cant or make the appropriate adjustment to the point of aim at the target. As has been learned from competition shooting, extreme accuracy of hitting the target typically requires a precisely trained and practiced shooter and a custom-set rifle that is calibrated to the shooters particular method of holding and aiming the firearm. Cant compensation is critical to improving shot accuracy. The special relationship between the shooter and his weapon (i.e., knowing where the projectile will travel when aimed this particular way, in this particular environment, and on this particular weapon) is extremely important in high-accuracy shooting. Modern ballistic software-based calculators also have a function that the shooter can input the cant offset and the appropriate aim corrections are computed and displayed. The present invention allows the same level of high-accuracy shooting because every cant indicator is precisely machined and attached to the particular stock design which employs the device. Therefore, a given shooter can pick up any weapon with the invention installed and the cant compensation will be precise and repeatable. Now, a trained shooter has multiple weapons each with a predictable response to cant compensation. This eliminates the limitation that a shooter often has only one rifle which they can use that must be set up by a specialist for high-accuracy shooting. In addition, with the system of the present disclosure, more shooters can be trained because more weapons are available with high-accuracy cant compensation systems.

Figure 2:
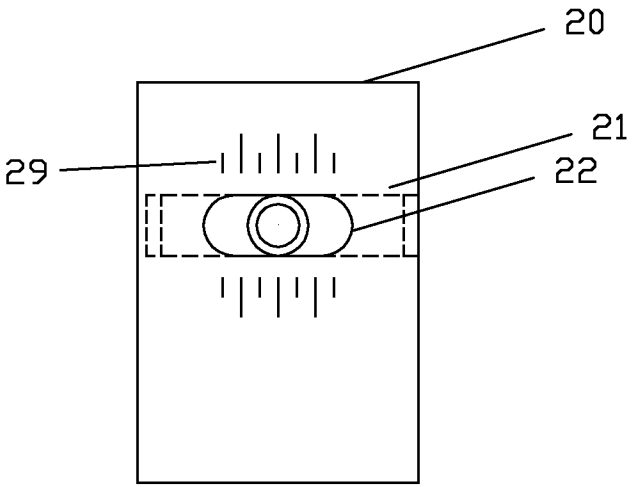
FIG. 2 top side view of the invention showing the bubble and calibration marks.

FIG. 2 illustrates a top view of the section of the rifle containing the precision-machined bubble-level system that comprises the invention. In one embodiment of the invention, the device is machined out of a solid block 20 (For example, as shown in FIG. 1 out of a component of the stock or the stock itself just behind the action receiver). Different materials can be used depending on the level of cost and durability desired. A cavity for receiving a bubble level is machined directly into the section of the stock 20 just behind the action receiver. The dashed lines 21 indicate a tubular cavity that is machined out of the block through from one side but does not extend completely through to the other side. This allows the bubble level tube to be inserted or removed from one side and when pushed in, is held in proper place by contacting the closed end of the cavity. This cavity length is also precisely machined so that the bubble level, when inserted, is correctly aligned to the gradient markings 29. The diameter of the cavity is machined with very close tolerances (0.001" typically) to the diameter of the bubble-level inserted therein. The length and width of the cavity 21 are dictated by the diameter and length of the particular bubble-level incorporated into the weapon system. In one embodiment, the bubble level is 0.375" in diameter and the length is 1.500." An oval-shaped viewport 22 is machined into the top face that allows the shooter to view the bubble level tube that is inserted into the cavity. A bubble-level comprised of a glass or plastic tube sealed on both ends and containing a phosphorous liquid or other fluorescent liquid, but not completely filled, such that a bubble exists within the sealed tube. In this Figure, gradient markings 29 are spaced apart evenly along both the top edge and bottom edge of the viewport 22. These markings provide a reference point for the shooter to judge the level of cant displayed by the movement of the bubble within the level either to the left or right of true center. The markings are evenly spaced but are primarily for consistent reference and do not represent any actual degree of rotation. Once the shooter practices firing the weapon in a canted situation, the location of the bubble relative to the left or right count of the markings is sufficient for the shooter to be accurate in cant compensation in other shooting circumstances. The gradients can be converted to actual degree of cant rotation simply by field calibration. This may be desirable, for example, if the shooter is using a ballistics software program that requires degree of rifle cant as an input value to the calculation.

Figure 3:
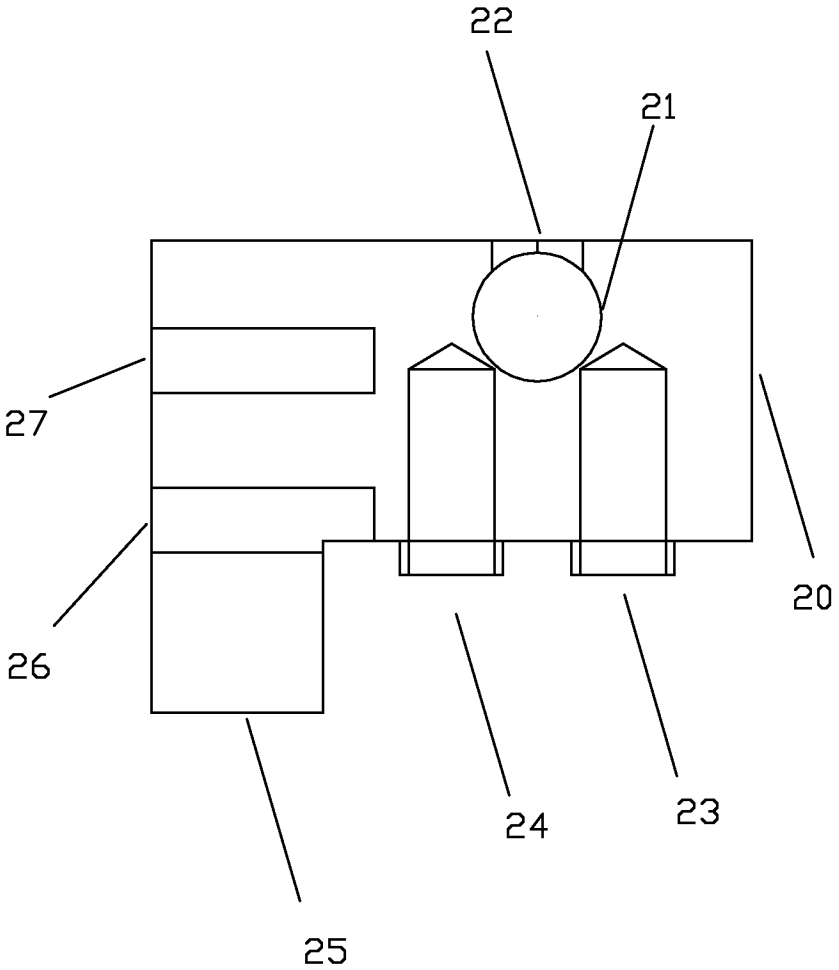
FIG. 3 is a left side view of the invention showing the various compartments housing the bubble level and interfacing with the remained of the rifle components.

FIG. 3 illustrates a side view of one embodiment of the current invention showing various elements machined into the block 20 (In the embodiment shown in FIG. 3, into a removable piece of solid material 20 that is inserted between the butt of the rifle and barrel/action receiver above the rifle's grip section). Items 23 and 24 are drilled and tapped to receive an attachment mechanism, such as machine screws, for attaching the invention to the section of the stock above the grip of the stock. In one embodiment, these machine screws are ¼" diameter×⅝" length and tapped to standard machine threads. All external surfaces of the invention are machined to flat to ensure that the device attaches securely and is aligned with the other elements of the weapon that are attached to the bubble level insert. When properly placed on top of the weapon's grip section, these two screws point upward and secure the device to the grip section. In one embodiment items 26 and 27 are machined and tapped cavities receive four attachment mechanisms. These attachment mechanisms secure and align the device to the butt of the rifle (i.e., stock). In one embodiment, the attachment mechanisms are 10/32" machine bolts. The invention also includes a contact base 25 that extends down below the back end of the stock. This left side of this extended surface provides a contact surface for attaching a folding hinge piece or any other accessory item bolting on to the back end of the stock.

In one embodiment, the same principles for housing the bubble level can be applied to raise the cant level indicator above the top surface of the stock. In one such embodiment, a rectangular bubble holder (or other shaped object or mass) is machined that protrudes upward from the top surface of the stock, behind the receiver. In this embodiment, the bubble holder has a cavity within it that is aligned with the horizontal axis of the barrel. As with other embodiments, the bubble level fits into the cavity so that the bubble level is aligned with the horizontal axis of the barrel when it is inserted into the cavity. As with other embodiments, the bubble holder also has a view port machined into the bubble holder so that a shooter can see the bubble inside the bubble holder. In some embodiments, the view port is on the top of the bubble holder. In other embodiments, the view port is on a rear-facing side of the bubble holder. In other embodiments, the view port is on both the rear-facing and the front-facing side of the bubble holder so that light will pass all the way through the bubble level. The bubble holder can be any shape or size so long as it does not interfere with the shooter's view of the sight reticle. In one embodiment, the bubble level is suspended in a frame extending at least partially above the top surface of the stock behind the receiver. In one embodiment, the frame is attached to the stock. In one embodiment, the frame is a unitary piece of the stock (i.e., part of the stock) or is part of a larger component of the stock. In an embodiment with a frame protruding at least partially from the top surface of the stock, the bubble level is held inside the frame and the bubble level can be protected by the frame against being bumped or knocked out of alignment with the horizontal axis of the barrel.

In another embodiment, the cant indicator can be machined directly into the action receiver of a rifle. A firearm receiver has several components, including a bolt assembly and a receiver body. The bolt assembly has a body, a handle, and a rear firing pin shroud. The receiver body is typically a tube-shaped support for the bolt assembly. Generally, a receiver body has a tang (rear facing end of the action receiver, often tapered and located below the firing pin shroud when the action receiver is assembled) that extends from the back of the action receiver. In such an embodiment, a cant level indicator can be machined directly into the tang. In such an embodiment, a cavity and a view port are machined into the tang either from the side or from the top. The cavity in such an embodiment is similar to other embodiments and holds a bubble level within the tang. Of course, a smaller bubble lever and cavity may be required to fit into the tang. The view port allows a shooter to see the bubble level within the cavity. In some embodiments, the bubble level is only partially recessed into a top surface of the tang, and a view port is not required because part of the bubble level is above the top surface of the tang.

Figure 4:
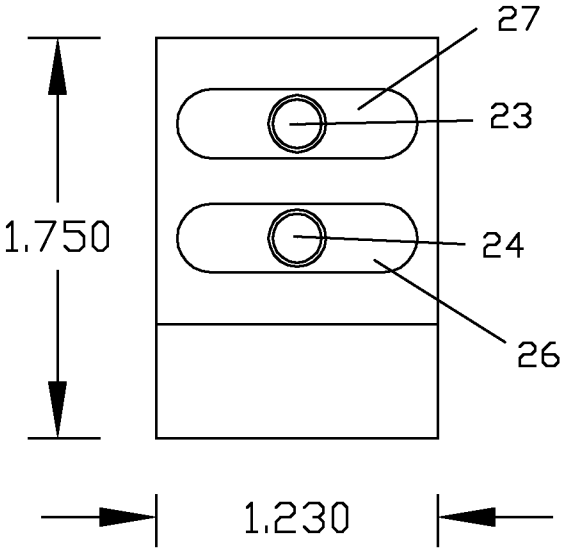
FIG. 4 is bottom view of one embodiment of the invention indicating length and width dimensions.

In reference to FIG. 4, the bottom view of the invention in FIG. 3 shows the two threaded holes 23 and 24. In addition to securing the invention to the stock via these attachment mechanisms, two ovular sections 26 and 27 are removed from the insert assembly for receiving similarly-shaped raised sections placed on top of the rifle's grip section. This "tongue and groove" style connection ensures that the invention is properly aligned and located relative to other components that make up the weapon assembly. This connection also adds strength to the invention and weapon's grip section to better handle the stresses of firing the rifle and the weight of the stock components that are bolted to the bubble level insert. In one embodiment, the height and width of the bubble level insert is 1.75" and 1.23" respectively. However, it is understood that the dimensions of the invention are relative to the size of the bubble level device incorporated into the firearm.

Figure 5:
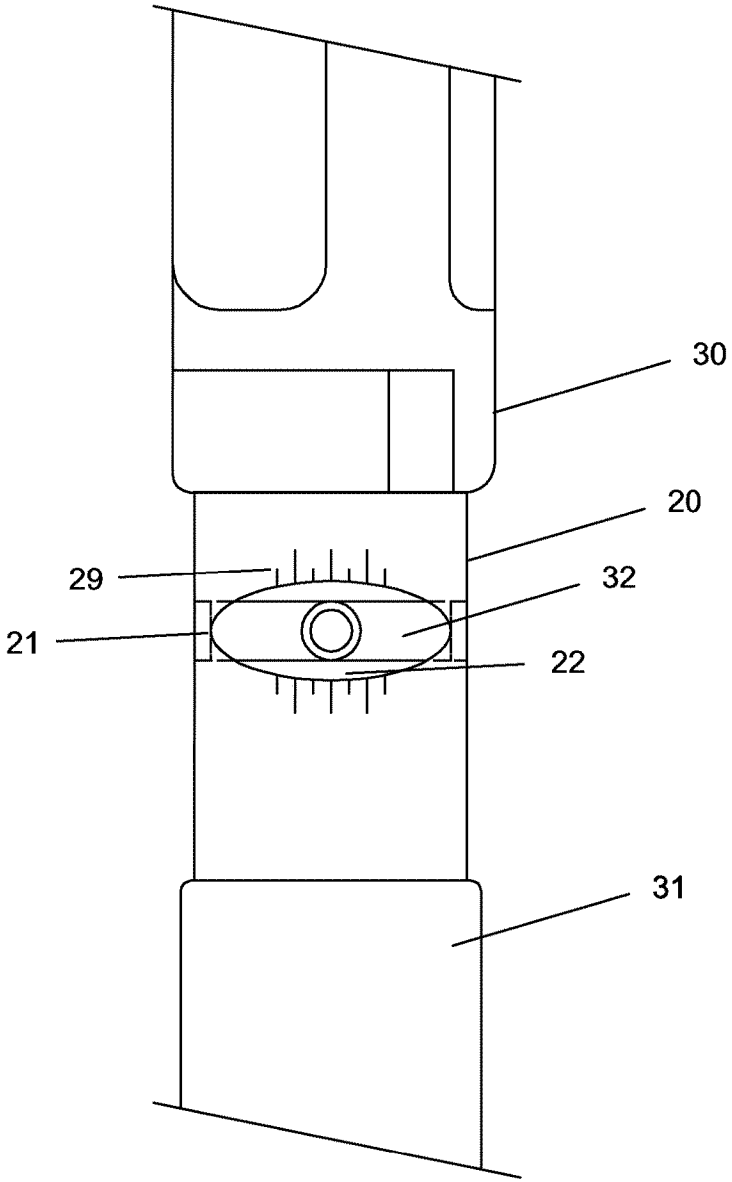
FIG. 5 is a top-down view of a cant indicator positioned between a bolt-action receiver and a rifle's stock section.

In reference to FIG. 5, a cant indicator assembly 20 is shown positioned between a bolt-action receiver 30 and the shooter and is incorporated into the rifle's stock section 31. In this position, a shooter would have the vantage point of viewing the bubble level 32 when gripping the rifle in a firing position. In the event a sight reticle is also installed above the action receiver, the shooter can readily view the cant indicator 20 after viewing the sight reticle simply by glancing the eyes downward. Little to no head movement is required, which allows the shooter to more effectively concentrate on the sight reticle view and adjust the aim to account for any cant indicated by the bubble level. At longer and longer target distances, even subtle rifle alignment errors can greatly magnify the projectile's flight path away from the desired location. Consequently, a shooter will desire to perform the least amount of physical movement when focusing his or her aim. This reduction in unnecessary movement includes controlling breathing, slowing the body's pulse, and minimizing head and body movements. By positioning the cant indicator 20 behind the action receiver, a shooter can readily make a last-second check and compensate for cant just before the rifle is fired at the target. To further enhance the shooter's accuracy in calibrating the rifle's cant/sight reticle compensation relationship, division lines 29 can be located either above or below the viewport cavity 22 that allow even more precise assessment of the bubble's offset from true center. In another embodiment, the rifle's stock material can be removed around the bubble level 32 to enlarge the viewport cavity 22. By removing more stock material and enlarging the viewport cavity 22 around the cant indicator assembly 20, additional weight can also be removed from the rifle, which may be desired by the shooter.

Figure 6:
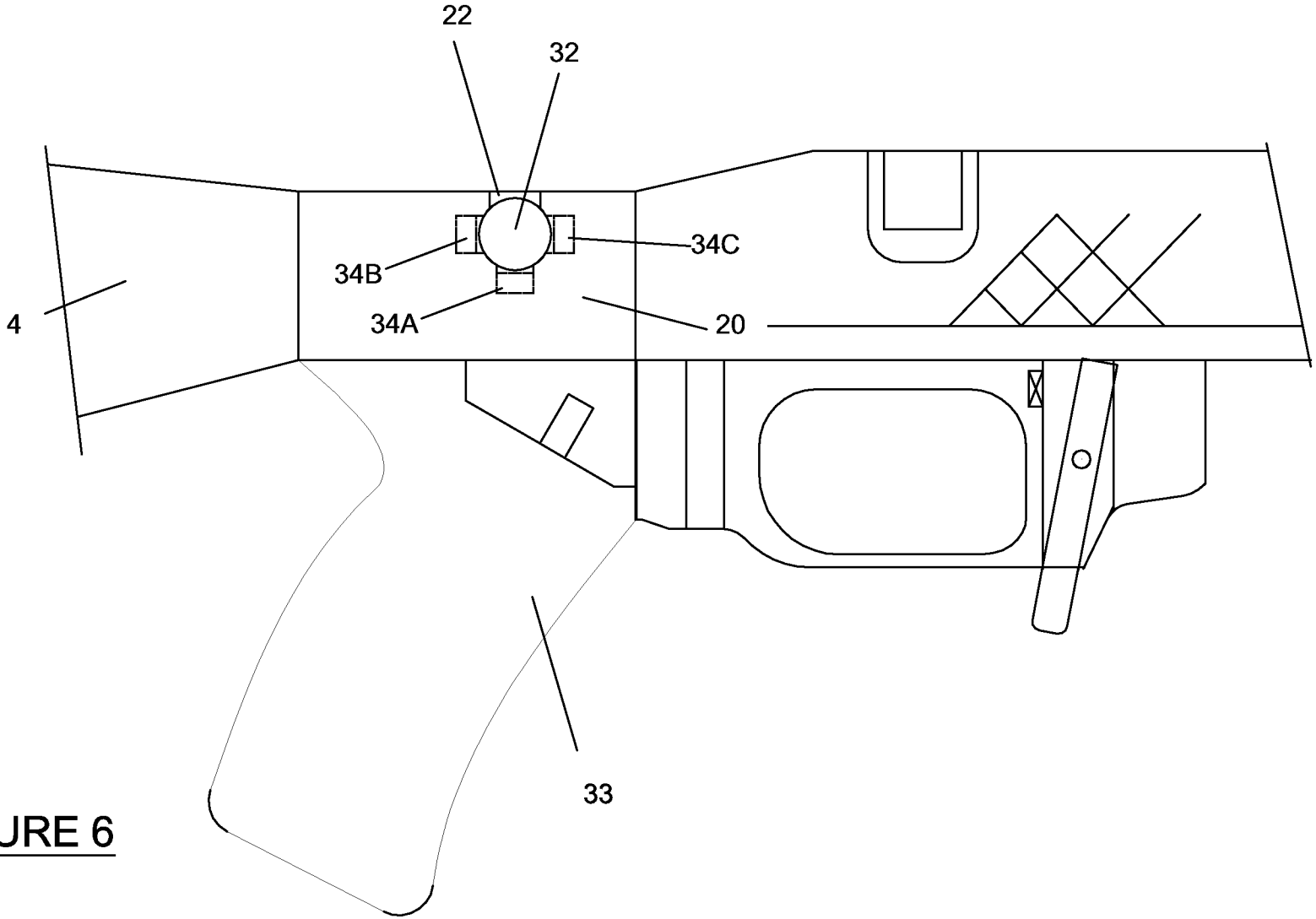
FIG. 6 is a side view of a firearm with a cant indicator having a light source to illuminate the bubble within the bubble level.

In reference to FIG. 6, a side view of the cant indicator assembly 20 is shown positioned above a firearm's grip section 33. A light-source cavity 34A can be installed into the firearm's stock section near or adjacent to the bubble level 32 and extending below and away from the bubble level 32. The light source can be placed within this cavity 34A before the bubble level 32 is inserted, so that the light projects up and illuminates the bubble level 32 when the bubble level 32 is in place. The size and dimensions of the light-source cavity are determined by the size of the light-source itself, or by preference. The luminosity of the light source may also vary depending on the preferences of the shooter. The light source may also be removable from the cavity or periodically changed based on the preference of the shooter or if the light source needs to be recharged or replaced. In one embodiment, the light-source cavity may be larger than the light source to allow the light to radiate in several directions. When the bubble level is inserted into its cavity, the light-source is also secured within its cavity. By controlling the lumens or location of the light source, a shooter can observe the rifle's cant in dark environments. In one embodiment, the light source is positioned on a rifle so that it cannot be seen by anyone other than the shooter so as not to give away his position. For example, if the light source is above the top surface of the stock section, that light could also be observed and detected from the side of the rifle. Phosphorous-containing fluorescent liquids can be charged by an external light source but relatively quickly dissipate that fluorescent charge when removed to a dark environment. Material such as tritium, a radioactive isotope of hydrogen, naturally fluoresces as it decays and has long been used as a radioluminescent light source for watches and instruments. A tritium light source, for example, could be an ideal material for military firearms because it can last the lifetime of the firearm and requires virtually no maintenance. However, any other light source or bubble level type could be used. In one embodiment, the light source cavity 34A is located below the bubble level so that the light source projects upward toward the viewport 22 to backlight the bubble level from the shooter's perspective. However, the light source can generally be located at other points around the bubble level, such as in front of the bubble level 34B (9 o'clock position) or behind the bubble level 34C. In one embodiment, both the light source and the bubble level are embedded below the upper surface of the stock section for protection. However, in another embodiment, the light source is fully embedded within the stock section but the bubble level is only partly embedded within the stock section. In another embodiment, the bubble level and light source cavities are incorporated into the rear end of the action receiver closest to the shooter instead of within the forward end of the stock section. In another embodiment, a combination of phosphorous-based luminescent fluid is placed within the bubble level 32 and tritium is used as the light source inside the light source cavity such that the tritium causes continuous luminescence of the fluid within bubble level. In addition to using the illuminated bubble level in dusk and twilight situations, the light source can also make the bubble level more visible in the daytime where external solar light is limited by cloud cover or the shooter's particular firing environment is intentionally darkened in some way to obscure his location. In an embodiment with a bubble level in the tang, the light source can be positioned below, in front of, or behind the bubble level as with other embodiments. In some embodiments, the light source is in the stock near the tang.

In yet other embodiments, a light source is used to illuminate the cant indicator assembly, but is located some distance from the cant indicator assembly. The remote light source emits light which is directed towards the cant indicator assembly via channels or fiber optics. For example, a battery powered light emitting diode (LED) is located within the pistol grip. The LED emits a light into a hollow channel that travels between the LED and the cant indicator assembly, more specifically, ends at or around the bubble level indicator within the viewport. Likewise, a fiber optic cable may be used within or in place of the channel to direct light from the LED to illuminate the bubble level of the cant indicator assembly. In fact, in certain exemplary embodiments, one or more fiber optic cables may transmit light from a remote light source to one or more locations in or about the cant indicator assembly, including the front, back, bottom, or sides of the bubble level.

In these various embodiments, the remote light source may include one or more battery powered LED lights integrated within or externally to the weapon, for example integrated within the stock section or pistol grip, or secured externally to the weapon, or be separate from the weapon. For example, and as described above, the light source may be a battery powered LED within the pistol grip. Alternatively, the light source may be a battery powered LED embedded within the stock. In yet another alternative, the light source may be a tritium or other radioactive power based light integrated within the stock or pistol grip. Further embodiments include light sources secured externally to the weapon, for example, a battery powered LED light affixed to the stock of the weapon. In fact, the light source may not even be physically connected to the weapon. For example, in certain embodiments, the light source may be a flash light or even sun light that is incident upon the weapon, whereby the light incident upon the weapon is directed through channels or fiber optics toward the cant indicator assembly to illuminate the bubble level (or other level indicator) therein.

Other embodiments of the current disclosure provide for the same light source that illuminates the cant indicator assembly to also illuminate other features of the weapon, including gun sights and safe or fire positions.

For battery powered or selectively engaged light sources, certain embodiments of the current disclosure include a switch for engaging and disengaging the light source. For example, a pressure switch is integrated into the pistol grip of the weapon such that when a user grasps the pistol grip, the switch is engaged and the light source is illuminated. Likewise, when the user releases the pistol grip, the switch is disengaged and the light source is extinguished.

Although generally bubble levels are elongated tubular chambers incompletely filled with a liquid, various other changes may be made to the apparatus in size, proportions, and material of construction to accommodate other bubble level chamber designs without departing from the meaning, scope, or intent of the claims which follow.

What I claim for Letters Patent is:

1. A method of compensating for the cant of a rifle comprising identifying a target in front of a barrel of a rifle, the rifle comprising a stock, an action receiver, a centerline axis and a cant measuring device further comprising a cavity positioned within the rifle's stock behind the action receiver having a front wall, and at least one side wall, a level indicator placed into the cavity such that the level indicator indicates when the rifle is at zero cant, and a light source within the stock configured to illuminate the level indicator; aligning the barrel with the target; assessing the degree of cant to the rifle by observing the left or right displacement of the level indicator; and rotating the rifle about an axis of the barrel such that the level indicator indicates zero cant.

2. The method of claim 1 further comprising the step of realigning the barrel relative to the target after removing the cant from the rifle.

3. A method of compensating for the cant of a rifle having a barrel, a stock, a level indicator embedded into the stock, the level indicator in line with the axis of the barrel, and a light source configured to illuminate the level indicator, the method comprising: identifying a target and its proximate distance from the rifle; aligning the rifle with the target; assessing the degree of cant to the rifle using the alignment of the level indicator relative to the centerline axis of the barrel; and rotating the rifle about the axis of the barrel such that the level indicator aligns with the centerline axis of the barrel.

4. A cant measuring device for a rifle stock, the stock further comprising: a cavity in the stock that is configured to hold a level indicator aligned with the cant axis of the stock; a topside of the stock having a view port in the stock such that the cavity can be viewed when the stock is held in a shooting position; a level indicator inserted into said cavity through an opening in a sidewall and the hole having a diameter equal to or larger than the level indicator.

5. The device of claim 4, wherein when the stock is assembled with a barrel and receiver, the level indicator of the device will indicate the extent to which the rifle is tilted about the cant axis.

6. The device of claim 4, further comprising a light source embedded in the stock, wherein when the light source is illuminated it illuminates at least part of the level indicator.

7. The device of claim 6, the light source further comprising a light emitting diode.

8. The device of claim 6, the light source further comprising a light emitting diode and a fiber optic cable, where one end of the fiber optic cable is proximate to the light emitting diode, and where the other end of the fiber optic cable is proximate to the level indicator, and where the light emitting diode is embedded within the stock, and where the other end of the fiber optic cable is proximate to the front, back, bottom or side of the level indicator.

9. The device of claim 6, the light source further comprising a light-emitting radioactive material.

10. The device of claim 6, the light source further comprising a light-emitting radioactive material.

11. A cant measuring device for a rifle stock comprising: a stock having a top surface, a side, and a forward end, the forward end for attaching to an action receiver and a barrel; a cavity in the forward end of the stock and recessed below the top surface of the stock, further comprising: a first end open to the side of the stock, level indicator inserted in the cavity, and a view port in the top surface of the stock for viewing the level indicator.

12. The device of claim 11, further comprising a light source embedded in the stock, wherein when the light source emits light, it illuminates at least part of the level indicator.

13. The device of claim 12, the light source further comprising a light emitting diode.

14. The device of claim 13, the light source further comprising a light emitting diode and a fiber optic cable, where one end of the fiber optic cable is proximate to the light emitting diode, and where the other end of the fiber optic cable is proximate to the level indicator, and where the light emitting diode is embedded within the stock, and where the other end of the fiber optic cable is proximate to the front, back, bottom or side of the level indicator.

15. The device of claim 12, the light source further comprising a light-emitting radioactive material.

16. A cant measuring device for a rifle stock comprising a body having a top surface and a side; a cavity in the body and recessed below the top surface of the body, further comprising: a level indicator inserted in the cavity, a light source in the body configured to illuminate the level indicator; and a view port in the top surface of the body for viewing the level indicator.

17. The device of claim 16, further comprising the level indicator aligned at zero degrees of cant.

18. The device of claim 16 further comprising the level indicator oriented perpendicular to the vertical centerline of the body.

19. The device of claim 16, further comprising a light emitting diode and a fiber optic cable, where one end of the fiber optic cable is proximate to the light emitting diode, and where the other end of the fiber optic cable is proximate to the level indicator, and where the light emitting diode is embedded within the body, and where the other end of the fiber optic cable is proximate to the front, back, bottom or side of the level indicator.

20. A method of machining a cant measuring device for a firearm comprising: determining a cant axis of a stock; machining a first cavity below a top surface of the stock to receive a level indicator, the first cavity being perpendicular to the cant axis of the stock and being larger than the level indicator; machining a view port in the top surface of the stock to view the first cavity; and embedding the level indicator within the first cavity; and installing a light source in a second cavity; wherein the level indicator indicates when the stock is at zero degrees of cant on the cant axis and the level indicator can be viewed through the view port on the top surface of the stock, and further wherein the light source is configured to illuminate the level indicator.

* * * * *